United States Patent [19]

Spanopoulos

[11] Patent Number: 4,597,347

[45] Date of Patent: Jul. 1, 1986

[54] ROLLER BOOM REEFING AND HOISTING OF A SAIL

[76] Inventor: George Spanopoulos, 44 Cumberland Court, London, England, W1 GB

[21] Appl. No.: 634,018

[22] PCT Filed: Nov. 28, 1983

[86] PCT No.: PCT/GB83/00305

§ 371 Date: Jul. 19, 1984

§ 102(e) Date: Jul. 19, 1984

[87] PCT Pub. No.: WO84/02114

PCT Pub. Date: Jun. 7, 1984

[30] Foreign Application Priority Data

Nov. 29, 1982 [GB] United Kingdom ..... 8233941

[51] Int. Cl.[4] ..... B63H 9/10

[52] U.S. Cl. ..... 114/106; 114/107

[58] Field of Search ..... 114/106, 107, 39, 98

[56] References Cited

U.S. PATENT DOCUMENTS

| | | | |
|---|---|---|---|
| 2,197,654 | 4/1940 | Beaudry | 114/107 |
| 3,132,620 | 5/1964 | Court | 114/106 |
| 3,260,230 | 7/1966 | Kauert | 114/106 |
| 4,324,192 | 4/1982 | Ingouf | 114/106 |

FOREIGN PATENT DOCUMENTS

| | | | |
|---|---|---|---|
| 456664 | 2/1928 | Fed. Rep. of Germany | 114/106 |
| 601605 | 5/1948 | United Kingdom | 114/106 |

*Primary Examiner*—Sherman D. Basinger
*Assistant Examiner*—Thomas J. Brahan
*Attorney, Agent, or Firm*—Kuhn Muller and Bazerman

[57] ABSTRACT

Mechanism for hoisting and reefing a sail on a sailing vessel wherein the foot of the sail is connected along its length to a roller boom, and wherein the hoisting and reefing of the said sail is effected by halyard means passing over a pulley at an upper portion of a mast associated with the said roller boom and connected at one of its ends to a hoisting drum and connected at the other end to a reefing drum, and is also connected to the peak of the sail, and wherein the said reefing drum is connected to the said roller boom whereby the boom is rotatable with the said reefing drum, characterized in that there are provided: (a) rotatable clutch (25) means for selectively rotating the said hoisting drum (8) and the said reefing drum (4)(b) selective engaging and locking means (9, 9a, 26, 28) for selectively engaging the said clutch to the said hoisting drum or the said reefing drum, and automatically to lock the said hoisting drum with the said reefing drum at the end of a hoisting operation, and to unlock the said drums at the start of a reefing operation, and (c) brake means (12, 13) for providing a braking force on the hoisting drum during a reefing operation whereby free fall of the sail during reefing is prevented.

13 Claims, 2 Drawing Figures

ROLLER BOOM REEFING AND HOISTING OF A SAIL

Figure 1:
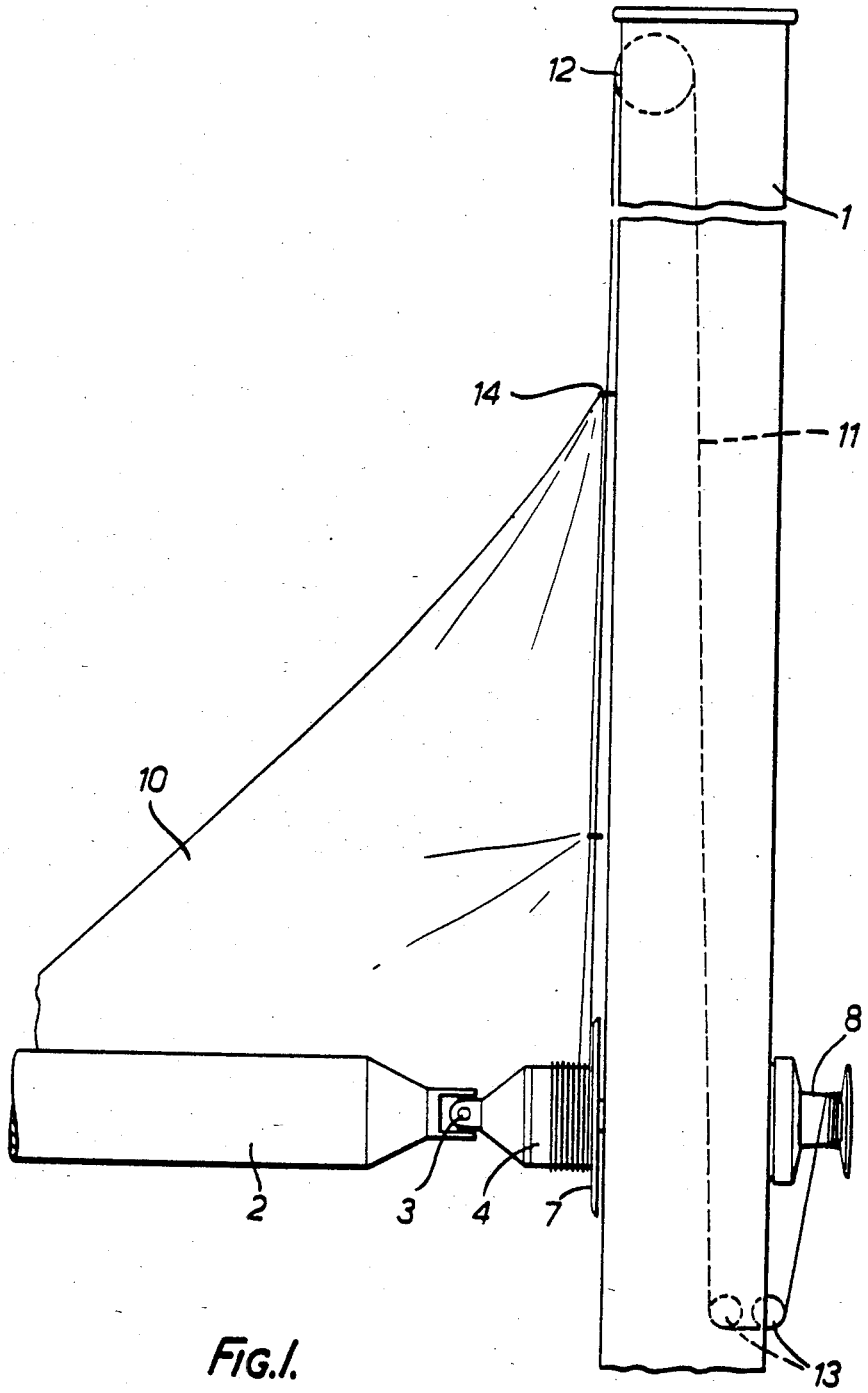

This invention relates to a mechanism for reefing and hoisting of a sail on a sailing vessel which is connected along its foot to a roller boom and wherein the rotation of hoisting and reefing drums by a halyard arrangement of the sails are controllable with respect to each other by a single crew member, the sail may be locked in any hoisted position and also free fall of the said sail during a reefing operation is prevented.

The hoisting and reefing of a sail which is connected to an axially-rotatable boom is a complicated maneuver to carry out. Thus conventionally the sail is hoisted by turning a winch around which a hoisting halyard connected to the peek of the sail is wound, and during a reefing operation the winch is unwound and the rotatable boom rotated by hand to roll the sail around it during its controlled fall, which operation requires at least two crew members to achieve the required result.

An alternative arrangement is to provide a reefing drum connected to the sail roller boom, halyard means being arranged to pass over a pulley at an upper position of the mast and connected at one of its ends to the hoisting drum and at its other end to the reefing drum and also connected to the peak of the sail. With such an arrangement it is however difficult to compensate for the build-up of halyard on the drums which thus require to be rotated at different relative speeds if the sail is not to be subjected to undue strain as it is rolled or unrolled from the roller boom. It is difficult to secure rapid locking of the sail in any particular position, the halyard normally being secured around a clean which is time-consuming. Furthermore if the reefing drum is unconnected from the hoisting drum, it is difficult to prevent free fall of the sail during a reefing operation.

The present invention overcomes such difficulties in that the hoisting and reefing operations may be carried by a single crew member, if desired by remote control e.g. from a steering position, and which furthermore may be operated by one or more prime mover e.g. an electric or hydraulic motor The invention provides a mechanism for hoisting and reefing a sail the foot of which is connected along its length to a roller boom, and wherein the hoisting and reefing of said sail is effected by halyard means passing over a pulley at an upper portion of a mast associated with the said roller boom and connected at one of its ends to a hoisting drum and connected at the other end to a reefing drum, and is also connected to the peak of the sail, and wherein the said reefing drum is connected to the said roller boom whereby the boom is rotatable with the said reefing drum, characterised in that there are provided (a) rotatable clutch means for selectively rotating the said hoisting drum and the said reefing drum (b) selective engaging means for selectively engaging the said clutch to the said hoisting drum or the said reefing drum, and to automatically lock the said hoisting drum with the said reefing drum at the end of a hoisting operation, and to unlock the said drums at the start of a reefing operation, and (c) brake means for providing a braking force on the hoisting drum during a reefing operation whereby free fall of the sail during reefing is prevented.

Preferably the clutch means comprises a clutch body portion connectable to the said reefing drum to rotate the said reefing drum in a reefing direction and a clutch surface which engages the said hoisting drum when the clutch means is rotated in one direction to effect rotation of the said hoisting drum, and which disengages the hoisting drum when rotated in the opposite direction while simultaneously the rotating clutch body portion is connected to the reefing drum to effect rotation of the said reefing drum.

A particularly useful form of such clutch means consists of a ring gear forming the said clutch body portion, the geared periphery of which is driveably connectable to the said reefing drum to rotate same in a reefing direction only, and one side face of which is provided with dog-tooth elements engageable in corresponding slots in a facing surface of the said hoisting drum to form the said clutch surface.

Such a ring clutch, when provided with helical teeth on its periphery, forms part of a particularly effective embodiment of the said selective engaging and locking means, providing an automatic selective and locking engaging means comprises a drivable helically-toothed gear which is in engagement with helically-toothed said ring gear which is axially slideably mounted whereby when the said ring gear is rotated in one direction by the said helically-toothed gear causes engagement of the said clutch face by a throwing action caused by reaction forces between the two sets of helical teeth, and rotation in the other direction causes retraction of the said helically-toothed ring to its original position by opposite said forces causing disengagement of the said clutch surface from the hoisting drum and simultaneous automatic engagement of the clutch body portion with the reefing drum.

Preferably the simultaneous automatic engagement of the clutch body portion with the the said reefing drum by the said clutch body portion is effected by ratchet means between the said clutch body portion and a shaft on which the said reefing drum is fixedly mounted.

Preferably the said brake means comprises a spring-loaded surface bearing against a surface of the said hoisting drum whereby friction forces acting between the two surfaces effects retarding of the hoisting drum during a reefing operation.

Figure 2:
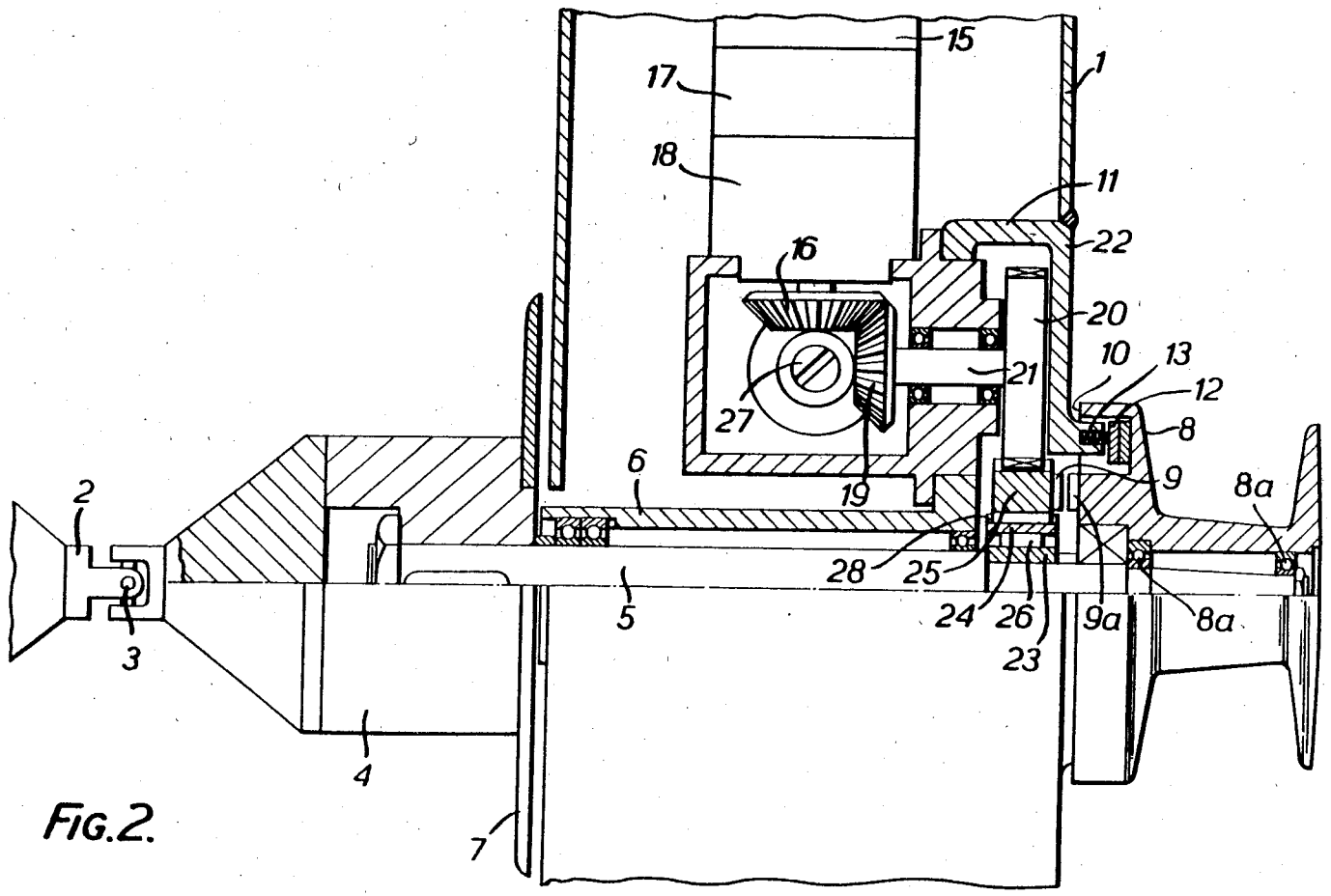

The invention is hereinafter described in more detail in the accompanying drawings, of which FIG. 1 is a schematic elevational view of one embodiment of the invention, and FIG. 2 is an elevation partial cross-section of the hoisting and reefing mechanism of the arrangement of FIG. 1.

In the drawing, a hollow metal mast 1 of a sailing vessel is provided with a roller boom 2 connected by a universal joint 3 a reefing drum 4 fixedly mounted on one end of shaft 5 which is freely rotatably mounted through the said mast 1 in housing 6. The reefing drum 4 is provided with a plate 7 at its end nearest the mast to protect the mast from build-up of halyard on the drum 4 during reefing operation.

On the other projecting end of the said shaft 5 there is freely rotatably mounted a hoisting drum 8 on ball race 8*a*. A mainsail 10 is connected at intervals along its foot (by means now shown) to the roller boom 2. A halyard 11 passes internally of the mast passes over a pulley 12 at the head of the mast 1, one end of the halyard being connected to the reefing drum 4 so as to be windable therein the other end similarly being connected (after passing under further pulleys 13) to the hoisting drum 8. The halyard is connected at an intermediate point along its length to the peak 14 of the sail 10. If desired the halyard means may be split so that the ends connect to spaced points on the luff of the sail.

Internally of the mast there is provided a motor 15 connected to a bevel gearbox through a gear box 17 and safety clutch 18 to a bevel gear 16. The bevel gear 16 meshes with a further bevel gear 19 which is itself attached through shaft 21 to a vertically-disposed helical gear wheel 20 rotatably mounted in casing 22.

A ratchet ring 23 is fixedly attached on the said rotatable shaft 5 and is mounted inside and co-axial with a second ring 24 which co-operates therewith through a ratchet (26), whereby rotation of the said second ring 24 in one direction drives the shaft 5 (and also the reefing drum) and rotation of the ring 24 in the opposite direction disengages the shaft 5. The said second ring 24 contains a series of parallel longitudinal slots (28) on its external periphery engaging with corresponding longitudinal teeth in a third ring 25 forming the clutch body portion of clutch means mounted between the said helical gear 20 so that the ring 25 forming the clutch body portion is axially slideably mounted on the said second ring 24. The side surface of the third ring 25 facing the surface 10 of the hoisting drum is provided with locking dog teeth 9 thus forming the clutch surface of the clutch means. The whole assembly of gears 20, 23 24 and 25 is contained in casing 11 which has a projecting portion extending into a circular recess of the hoisting drum 8 and containing a compression spring 13 bearing against friction pads 12 to form a friction brake when in contact with the facing surface of the hoisting drum.

In operation the motor 15 is switched on to rotate in a direction to effect hoisting of the sail 10 whereby the reaction forces operating between the intercalating helical teeth on the gear 20 and ring 25 cause the ring 25 forming the clutch body portion to move to the right (as in the drawing) by moving along the co-operating axial slots of the ring 24, and the dog teeth 9 engage in corresponding slots 9*a* in the facing surface of the hoisting drum 8, and at the same time the ratcheting action between the second ring 24 and the first ring 23 causes disengagement between the rings 23 and 24 thus disengaging the reefing drum 4. By this means the sail 10 is hoisted to a required extent the reefing drum being unwound by upward movement of the halyard 11 which hitherto was wound on the reefing drum. When the motor 15 is stopped when the sail has been hoisted to the desired extent, the system becomes locked against any movement which would cause lowering of the sail by the action of the ratchet between the first and second rings 23 and 24 respectively thus connecting and locking the hoisting and reefing drums. By this action, the tension in the halyards is preserved against any flapping of the hoisted sail.

To lower the sail, the motor 3 is switched on to rotate in an opposite direction. This causes the dog teeth on the ring 24 to become disengaged from the surface 10 of the hoisting drum, the ratchet between rings 24 and 23 engaging ring 23 so as to effect rotation thereof, with corresponding rotation of the shaft 5 and reefing drum 4. Thus the reefing drum rotates to pull the sail down and at the same time to roll the sail over the rotating boom 2 which is connected to the reefing drum by universal joint 3. During this action the hoisting drum becomes disengaged and is rotated by the pulling action of the halyard wound onto it.

During the reefing operation the friction braking action exerted by the spring 13 against the friction pad 12 and the facing surface of the hoisting drum causes a retarding action against sudden fall of the sail.

If desired, a manually-operated over-ride mechanism 27 may be provided to operate the system manually should power to the motor 15 fail.

The motor 15 may be an electric or hydraulically-operated prime mover. In the embodiment shown the motor is contained within the hollow mast for protection against accidental knocking or the actions of waves. If desired it may be enclosed in a casing external of the mast to facilitate access.

While in the embodiment illustrated a single motor is used, if desired two independently-operated motors may be used to provide the actuating means, one driving the hoisting drum and the other driving the reefing drum, the two motors, being interconnected so that the two drums are simutanenously rotated in the appropriate directions, during hoisting and reefing operations. Alternative braking arrangements to the friction brake may be used and alternative clutch arrangements to the dog-tooth engagement illustrated, may be used.

A particularly useful manner of carrying out the utilizing an existing roller boom on a sailing vessel is to provide an attachable unit comprising a casing containing the mechanism hereinbefore described, connected to a hoisting drum motor and a power take-off wheel. The unit is then attached to the mast by suitable attachment means and a belt or chain is provided connecting the power take-off wheel to a roller boom, possibly through a reefing wheel, by a chain or rope to effect a reefing operation.

Thus the present invention represents a substantial improvement over conventional roller reefing arrangements, providing a comprehensive series of operations operable by a single person, if required by remote control of motor or motors used.

I claim:

1. Mechanism for hoisting and reefing a sail on a sailing vessel wherein the foot of the sail is connected along its length to a roller boom, and wherein the hoisting and reefing of the said sail is effected by halyard means passing over a pulley at an upper portion of a mast associated with the said roller boom and connected at one of its ends to a hoisting drum and connected at the other end to a reefing drum, and is also connected to the peak of the sail, and wherein the said reefing drum is connected to the said roller boom whereby the boom is rotatable with the said reefing drum, characterized in that there are provided:

(a) rotatable clutch means for selectively rotating the said hoisting drum and the said reefing drum: said clutch means comprising a ring gear forming a clutch body portion the geared periphery of which is driveably connectable to the said reefing drum to rotate the said reefing drum in a reefing direction only and a clutch surface formed on one side face of said ring gear which is provided with dog-tooth elements engageable in corresponding slots in a facing surface of the said hoisting drum, which engages the said hoisting drum when the clutch means is rotated in one direction to effect rotation of the said hoisting drum, and which disengages the hoisting drum when rotated in the opposite direction while simultaneously the rotating clutch body portion is connected to the reefing drum to effect rotation of the said reefing drum;

(b) selective engaging and locking means for selectively engaging the said clutch to the said hoisting drum or the said reefing drum, and automatically to lock the said hoisting drum with the said reefing drum at the end of a hoisting operation, and to unlock the said drums at the start of a reefing operation:

(c) brake means for providing a braking force on the hoisting drum during a reefing operation whereby free fall of the sail during reefing is prevented.

2. Mechanism according to claim 1, wherein the said selective engaging and locking means comprises a drivable helically-toothed gear which is in engagement with helically-toothed said ring gear which is axially slideably mounted, whereby when the said ring gear is rotated in one direction by the said helically-toothed gear causes engagement of the said clutch surface thereof by a throwing action caused by reaction forces between the two sets of helical teeth, and rotation in the other direction causes retraction of the said helically-toothed ring to its original position by opposite said forces causing disengagement of the said clutch face surface from the hoisting drum and simultaneous automatic engagement of the clutch body portion with the reefing drum.

3. Mechanism according to claim 2, wherein the said simultaneous automatic engagement of the clutch body portion with the said reefing drum is effected by ratchet means between the said clutch body portion and a shaft on which the said reefing drum is fixedly mounted, the said ratchet means also acting to lock the said hoisting and reefing drums at the end of a hoisting operation.

4. Mechanism according to claim 1, wherein the said brake means comprises a spring-loaded surface bearing against a surface of the said hoisting drum whereby friction forces acting between the two surfaces effects retarding of the hoisting drum during a reefing operation.

5. Mechanism according to claim 1 wherein the said actuating means is driven by a motor.

6. An attachable unit comprising the mechanism according to any one of claims 1 or 2 to 5 for attachment to a sailing vessel provided with a roller boom, comprising a casing containing the said rotatable clutch means, selective engaging and locking means and said brake means, all in operative connection with a hoisting drum, motor and power take-off for a reefing operation on the said sailing vessel.

7. Mechanism for hoisting and reefing a sail on a sailing vessel wherein the foot of the sail is connected along its length to a roller boom, and wherein the hoisting and reefing of the said sail is effected by a rope used as halyard passing over a pulley at the upper part of a mast and connected at one of its ends to a hoisting drum and the other end to a reefing drum with the luff of the sail being connected alongside the rope upwards to the reefing drum, wherein the said reefing drum is connected with the roller boom via a universal joint whreby the boom is rotatable with the said reefing drum, characterized in that there are provided:

(a) rotatable coupling means for selectively rotating the said hoisting drum and the said reefing drum;

(b) engaging and locking means for selectively engaging the said coupling to the said hoisting drum or the said reefing drum, and automatically to lock the said hoisting drum with the said reefing drum at the end of a hoisting operation and to unlock the said drums at the start of a reefing operation; and (c) brake means for providing a braking force on the hoisting drum during a reefing operation whereby the winding of the sail around the reefing drum and the boom is improved.

8. Mechanism according to claim 7, wherein the said coupling means comprises a coupling body portion connectable to the said reefing drum to rotate the said reefing drum in a reefing direction and a coupling surface which engages the said hoisting drum when the said coupling means is rotated in one direction to effect rotation of the said hoisting drum, and which completely disengages the hoisting drum when rotating in the opposite direction while simultaneously the rotating coupling portion is effecting rotation to the said reefing drum.

9. Mechanism according to claim 8, wherein the said coupling means consists of a ring gear forming the said coupling body portion the geared periphery of which is driveably connectable to the said reefing drum to rotate same in a reefing direction only, and one side face of which is provided with dog-tooth elements engageable in corresponding slots in a facing surface of the said hoisting drum, to form the said coupling surface.

10. Mechanism according to claim 9, wherein the said engaging and locking means comprises a drivable helically-toothed gear which is in engagement with helically-toothed said ring gear which is axially slideably mounted, whereby when the said ring gear is rotated in one direction by said helically-toothed gear causes engagement of the said coupling surface thereof by a throwing action caused by reaction forces between the two sets of helical teeth, and rotation in the other direction causes retraction of the said helically-toothed ring to its original position by opposite said forces causing disengagement of the said coupling face surface from the hoisting drum and simultaneous automatic engagement of the coupling body portion with the reefing drum.

11. Mechanism according to claim 10, wherein the said simultaneous automatic engagement of the coupling portion with the said reefing drum is effected by ratchet means between the said coupling body portion and a shaft on which the said reefing drum is fixedly mounted, the said ratchet means also acting at the end of the said hoisting and reefing drums at the end of a hoisting operation.

12. Mechanism according to the claim 7, wherein sliding brake means effects retarding of the hoisting winch drum during a reefing operation, to improve the winding of the said sail around the reefing winch drum and the boom.

13. Mechanism according to claim 7, wherein the said actuating means is driven by a prime mover.

* * * * *